US006841207B2

(12) United States Patent
Burch et al.

(10) Patent No.: US 6,841,207 B2
(45) Date of Patent: Jan. 11, 2005

(54) POROUS MEDIA COATINGS HAVING SURFACE-MODIFIED ALUMINA PARTICULATES

(75) Inventors: Eric L Burch, San Diego, CA (US); Loretta Ann Grezzo Page, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 107 days.

(21) Appl. No.: 10/261,378

(22) Filed: Sep. 30, 2002

(65) Prior Publication Data

US 2004/0062880 A1 Apr. 1, 2004

(51) Int. Cl.[7] ..... B41M 5/40

(52) U.S. Cl. ..... 428/32.36; 524/430

(58) Field of Search ..... 428/32.36; 524/430

(56) References Cited

U.S. PATENT DOCUMENTS

| | | | | | |
|---|---|---|---|---|---|
| 4,943,375 | A | * | 7/1990 | Bradshaw et al. | 210/674 |
| 5,702,610 | A | * | 12/1997 | Hagen et al. | 210/670 |
| 5,804,293 | A | * | 9/1998 | Nehmsmann et al. | 428/307.3 |
| 5,928,127 | A | * | 7/1999 | Tanuma | 516/93 |
| 5,985,425 | A | * | 11/1999 | Tomizawa et al. | 428/212 |

FOREIGN PATENT DOCUMENTS

| | | | |
|---|---|---|---|
| EP | 0716929 | A1 | 6/1996 |
| EP | 0937582 | A1 | 8/1999 |
| ER | 0696516 | A1 | 2/1996 |

* cited by examiner

*Primary Examiner*—B. Shewareged

(57) ABSTRACT

The present invention is drawn to systems and coated substrates for ink-jet ink printing. The coated media substrate can comprise a substrate, having coated thereon, a porous coating, wherein the porous coating comprises an alumina particulate having an active ligand covalently attached thereto or adsorbed thereon. Preferably, the alumina particulate is an aluminum oxide having surface hydroxyls.

26 Claims, No Drawings

POROUS MEDIA COATINGS HAVING SURFACE-MODIFIED ALUMINA PARTICULATES

FIELD OF THE INVENTION

The present invention is drawn to surface-modified alumina coatings for ink-jet media. The present invention is also drawn to ink-jet ink and coated media systems that provide good image permanence, good absorption of ink, and good resistance of ink-migration upon ink-jet printing.

BACKGROUND OF THE INVENTION

Computer printer technology has evolved to a point where high-resolution images can be transferred on to various types of media, including paper. One particular type of printing involves the placement of small drops of a fluid ink onto media surfaces in response to a digital signal. Typically, the fluid ink is placed or jetted onto the surface without physical contact between the printing device and the surface. Within this general technique, the specific method that the ink-jet ink is deposited onto the printing surface varies from system to system, and can include continuous ink deposit or drop-on-demand ink deposit.

With regard to continuous printing systems, inks used are typically based on solvents such as methyl ethyl ketone and ethanol. Essentially, continuous printing systems function as a stream of ink droplets that are ejected and directed by a printer nozzle. The ink droplets are directed additionally with the assistance of an electrostatic charging device in close proximity to the nozzle. If the ink is not used on the desired printing surface, the ink is recycled for later use. With regard to drop-on-demand printing systems, the ink-jet inks are typically based upon water and glycols. Essentially, with these systems, ink droplets are propelled from a nozzle by heat or by a pressure wave such that all of the ink droplets ejected are used to form the printed image.

There are several reasons that make ink-jet printing a popular way of recording images on various media surfaces, particularly paper. Some of these reasons include low printer noise, capability of high-speed recording, and multi-color recording. Additionally, these advantages can be obtained at a relatively low cost to consumers. However, though there have been great improvements in ink-jet printing, accompanying these improvements are increased consumer demands such as higher speeds, higher resolution, full color image formation, increased image durability, etc. As new ink-jet inks are developed, there have been several traditional characteristics to consider when evaluating the ink in conjunction with printing media. Such characteristics include edge acuity and optical density of the image on the surface, dry time of the ink on the substrate, adhesion to the substrate, lack of deviation of ink droplets, presence of all dots, resistance of the ink after drying to water and other solvents, long term storage stability, and long term reliability without corrosion or nozzle clogging. Though the above list of characteristics provides a worthy goal to achieve, there are difficulties associated with satisfying all of the above characteristics. Often, the inclusion of an ink component to address one of the above attributes prevents another being met. Thus, most commercial inks for use in ink-jet printers represent a compromise, in an attempt to achieve adequate performance in all of the above listed attributes.

Ink-jet inks are either dye- or pigment-based. Dye-based ink-jet inks generally, but not always, use water-soluble colorants. As a result, such dye-based inks are usually not always water fast. Prints made from these inks tend to undergo color change over time, or fading, when exposed to ambient light and air. The media surface can play a key role in the fade properties and wet fastness of an image in that for a given ink, the degree of fade and wet fastness can be highly dependent on the chemistry of the media surface. Therefore, for optimum performance, many ink-jet inks often require that an appropriate media be selected in accordance with the application, thus, reducing the choice of media. In the case of pigmented inks, it is the dispersed colorant particles that produce color. Often the line quality of prints produced by pigment-based inks is superior to that of dye-based inks. When a printed image is made with pigmented inks, solid colorant particles adhere to the surface of the substrate. Once the ink vehicle evaporates, the particles will generally not go back into solution, and are therefore more water fast. In addition, pigmented inks are often much more fade resistant than dye-based inks. Though pigmented inks, in some areas, exhibit superior performance, dyes in general produce inherently more color saturated and more reliable inks. Thus, dye-based inks have been more often used in applications where fade resistance is not primarily important.

In order for the ink-jet industry to effectively compete with silver halide photography, it is important that ink-jet prints must improve their image fade resistance. In other words, enhanced permanence of images has become important to the long-term success of photo-quality ink-jet ink technologies. According to accelerated tests and "industry standard" failure criteria, photographs have typically been known to last about 13 to 22 years under fluorescent light exposure. There are now even systems with published values of 19 to 30 years. The best dye based ink-jet printers produce prints that last for much less time under similar conditions.

A few categories of photographic ink-jet media are currently available: polymer coated media, clay coated media, and porous coated media. It is the polymer based type that produce the best known images, e.g. longest lasting, mentioned above. However, this category of media is generally inferior in dry time and wet fastness relative to porous coated media. On the other hand, image fade resistance and humid fastness of the porous coated media is generally lower than that of its polymer-based media counterpart. Therefore, there is a great desire to improve the image permanence of ink jet ink images on porous coated media, particularly with respect to alumina based coatings.

SUMMARY OF THE INVENTION

The compositions and coated substrates of the present invention comprise a chemically modified alumina coating.

With this in mind, a coated media substrate for ink-jet ink printing can comprise a media substrate having a porous coating printed thereon. The porous coating can comprise aluminum oxide particulates having surface hydroxyls, wherein the aluminum oxide particulates are modified by organic active ligands.

In an alternative embodiment, a system for producing permanent ink-jet ink images can comprise a substrate having a porous coating coated thereon, wherein the porous coating comprises active ligand-modified alumina particulates. The system can also comprise an ink-jet ink containing a composition configured for interacting with the active ligand portion of the active ligand-modified alumina particulates upon printing the ink-jet ink onto the porous coating.

DETAILED DESCRIPTION OF THE PREFERRED EMBODIMENT(S)

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

As used in this specification and the appended claims, the singular forms "a," "an," and "the" include plural referents unless the content clearly dictates otherwise.

"Image permanence" refers to characteristics of an ink-jet printed image that relate to the ability of the image to last over a period of time. Characteristics of image permanence include image fade, water fastness, humid fastness, light fastness, smudge resistance, air pollution induced fading, scratch and rub resistance, and inhibition of microbial growth.

"Media substrate" or "substrate" includes any substrate that can be used in the ink-jet printing arts including papers, overhead projector plastics, coated papers, fabric, art papers (e.g. water color paper), and the like.

"Active ligand" includes any ligand attached to an alumina particulate, either by covalent attachment or adsorption, that provides a function at or near the surface of an alumina particulate that is not inherent to an unmodified alumina particulate. For example, an active ligand can be used to reduce the need for binder when coating on a substrate, or can interact with a dye or other ink-jet ink component improving permanence.

"Reactive group" is any group that can be used to attach an active ligand to alumina. The reactive group can be attached directly to the active ligand at any functional location, or can be attached to the active ligand through a spacer group.

"Spacer group" can be any organic chain that can be used as a spacer to interconnect or link an active ligand to a reactive group. For example, a straight or branched chain having from 1 to 10 carbon atoms can be used. Numerous other spacer groups can be used as well, such as $—(CH_2)_b NH(C)O—$, $—(CH_2)_a O(CH_2)_b—$, or $—(CH_2)_b NH—$, where a is from 0 to 3 carbons, and b is from to 10 carbons. The spacer group can be attached to the alumina by one or more reactive group, e.g., a carboxyl group(s) or a silane group(s). A silane spacer group is an example of a reactive group combined with a spacer group. The former are exemplary only, as any functional spacer group can be used, provided it is functional in accordance with an embodiment of the present invention.

"Alumina" refers to a class of aluminum oxide particulates. Preferably, in the context of the present invention, aluminum oxide particulates having surface hydroxyls, such as boehmite, can be used. "Boehmite" includes compositions having the structure $[Al(O)(OH)]_n$, where n can be from 1 to 2. When n is 1, then the structure is AlO(OH). When n is 2, then the structure is $Al_2O_3.H_2O$.

"Surface-modified alumina," "active ligand-bound alumina," or "active ligand-modified alumina" can include alumina particulates or pigments, such aluminum oxides with surface hydroxyls, having an active ligand attached thereto, wherein the active ligand is either chemically attached to the alumina (either directly or through a spacer group), or wherein the active ligand is adsorbed thereon. For example, boehmite is reactive with carboxylic acids, and thus, carboxylic acid containing active ligands can be chemically attached to the surface of a boehmite particulate. Alternatively, an active ligand can be bound to an alumina surface through a silane group. Spacer groups can also be present between the alumina surface and the active ligand.

With this in mind, a coated media substrate for ink-jet ink printing can comprise a media substrate having a porous coating coated thereon. The porous coating can comprise an aluminum oxide particulate having surface hydroxyls, wherein the aluminum oxide particulates are modified by an attached organic active ligand.

Additionally, a system for producing permanent ink-jet ink images can comprise a substrate having a porous coating coated thereon, wherein the porous coating comprises active ligand-modified alumina particulates. The system can further include an ink-jet ink comprising a composition configured for interacting with the active ligand portion of the active ligand-modified alumina particulates upon printing the ink-jet ink onto the porous coating. The alumina particulates are preferably aluminum oxide particulates having surface hydroxyls.

With respect to both the method and system, the aluminum oxide having surface hydroxyls can be boehmite. Further, the organic active ligand can be configured to interact with dye or other ink-jet ink component. For example, if a cationic active ligand is present, the anionic dye molecule can be used.

The aluminum oxide of the system and method can be modified by the active ligand through covalent attachment, or through adsorption. With adsorption, the active ligand can be deposited onto the surface of the aluminum oxide particulates such that the active ligands are substantially stable during the coating process. With covalent attachment, direct attachment or attachment through an organosilane group can be used. In either direct attachment or attachment through an organosilane group, optionally, a spacer group can be present. In one embodiment, the organic active ligand can be attached to the aluminum oxide particulates through a silane group, and optionally, a spacer group. In another embodiment, the organic active ligand can be a carboxylic acid group such that the organic active ligand can be attached to the aluminum oxide particulate through a reactive product of a carboxylic acid group and at least one of the surface hydroxyls of the aluminum oxide particulates.

With respect to the system, the ink-jet ink can be configured to physically interact with the alumina particulate-portion of the active ligand-modified alumina particulates. Alternatively, a component of an ink-jet ink, such as a dye, can be present that is oppositely charged with respect to the active ligand.

Alumina particulates or pigments have been used in the prior art as part of a coating composition for inorganic porous media. However, such coatings often require the addition of binder compositions that are used to adhere the composition together. It has been recognized that the amount of binder that is often used can be greatly reduced by modifying the surface of the alumina particulates. In other words, certain active ligand molecules can be incorporated onto the surface of alumina compositions for a number of reasons. For example, modification of the surface of boehmite can improve its stability as part of a media coating composition. A typical binder that can be used for binding boehmite particulates is polyvinyl alcohol, though other emulsion polymers can be used. By modification of the surface of the boehmite with an active ligand molecule, less binder can be used. It is believed that the modified alumina described herein maximizes efficiency of added binder-like material by attaching such materials to the surface of the alumina, thereby reducing the need to include excess or large amounts of binder. One reason the use of less binder may be desirable is because the presence of too much binder in a coating can diminish image quality when printed upon. Further, the presence of too much binder in a coating can increase the viscosity of the coating material, thereby making the coating process more challenging.

Alternatively, active ligands can be attached to the surface of alumina particulates or pigments for other purposes as well. For example, an active ligand can be attached to an alumina surface such that the active ligand provides an interactive property between an ink-jet ink and the alumina surface upon printing. In one embodiment, dyes can be rendered more immobile on a substrate coated with an active ligand-modified alumina particulate-containing coating, thereby providing a more accurate print. To illustrate a more specific example, if an amine is attached to or adsorbed on a boehmite particulate, the presence of such a composition in a coating can attract sulfonic acid or carboxylic acid dyes found in many ink-jet inks once printed on the coating.

In either case, whether the active ligand molecule that is attached to or adsorbed on the alumina surface for stabilization of a particulate in a coating batch, or for interacting with a dye (or both), attachment can be carried out by reacting the ligand molecule to a hydroxyl group on the surface of an alumina particulate. For example, if the ligand molecule has a carboxyl group, then it can react with the hydroxyl group of a boehmite particulate. Alternatively, an active ligand can be bound to an alumina surface through a silane group (and optionally, a spacer group).

By attaching active ligand molecules to the surface of alumina particulates or pigments, improved substrate coating properties and performance can be achieved with respect to image-forming ink-jet inks. Considering the specific example of boehmite, this substance is generally polar in nature. Thus, by attaching or adsorbing an organic molecule to the surface, the surface properties can become less polar. This provides good properties with respect to the preparation and application of the composition as a coating. The more organic surface can improve the binding properties of the boehmite, and improve the binding interaction properties between the boehmite and an added binder. However, as the attached or adsorbed active ligand preferably does not completely encapsulate the boehmite, the boehmite can maintain its core cationic properties that are effective with respect to the attraction between the boehmite particulate and an anionic dye. More specifically, as boehmite particulates generally have a porous network, and as the entire surface is not completely coated, the boehmite particulates can still attract ink into its pores. Furthermore, the inorganic cations on the boehmite can be replaced with organic cations with improved properties.

Other advantages of the present invention are provided by the surface modification itself. For example, by surface modifying an alumina particulate, such as boehmite, one can control the isoelectric point of the composition. In other words, depending on the active ligand chosen for attachment, a particulate can be configured for use in certain pH environments. By modifying the surface of boehmite with an active ligand, the boehmite can retain its ion exchange and/or dye fixation properties, while at the same time, have the added advantage of providing a coating that can be tailored to have a desired surface charge and dye fixation properties. In one embodiment, the active ligand can be a ligand that is reactive with a dye, part of an ion exchange system, part of a dye fixing system, or for tethering other additives that would alter the properties of the boehmite, e.g., UV absorbing/protecting molecules, crosslinking agent, etc. If a crosslinking agent is used as the active ligand, then the crosslinking can occur between the boehmite modified composition and a crosslinking resin to improve wet and dry physical durability and water resistance.

One advantage of the present invention is the ability to provide a desired ligand as part of an alumina media coating wherein the active ligand is at or near the surface of the alumina particulate. By the use of such compositions, the active ligand is placed in close proximity to a dye being used as part of an ink-jet ink to print an image. Additionally, because the active ligand is at or near the surface of the alumina, a smaller amount of the active ligand compounds is necessary for use to provide a desired result.

The application of the surface-modified alumina coating composition can be conducted by using any of a number of methods known in the art, including the use of an air knife coater, a blade coater, a gate roll coater, a doctor blade, a Meyer rod, a roller, a reverse roller, a gravure coater, a brush applicator, a sprayer, a slot coater, and the like. Further, drying of the coating may be effected by conventional means such as hot air convection, microwave, infrared heating, or open air-drying. Typical substrates for coating include films, papers, and photographic media.

Once a paper or other substrate is coated in accordance with principles of the present invention, dyes can be selected for use as part of a system or method that have acceptable binding properties to the boehmite bound active ligand present as the coating. Alternatively, a coating composition can be selected for use after identifying an ink-jet ink or dye for use.

To describe general principles associated with the modification of an alumina particulate, the following exemplary preparative embodiment is described. Specifically, the surface of boehmite can be modified using aqueous colloidal boehmite dispersion at pH 3 to 4, boiled/refluxed for from 5 to 24 hours in the presence of a carboxy-alkyl with an active ligand group at or on the alkyl. This is one exemplary embodiment.

Whether the mode of attachment is through the above, or by other means, examples of active ligand groups can include carboxy acid such as propionic acid or lactic acid; an amine such as an amino acid, e.g., glycine or lysine; an alcohol such as a phenol; a carboxy alcohol such as hydroxyacetic acid; a quaternary amine such as betaine, or combinations thereof. Examples of active ligands that can be used also include those attached to alumina particulates through a silane spacer group. For example, the above active ligands can be attached to the alumina particulates through a silane-containing spacer group. Other examples of active ligands that are part of a silane-containing spacer group can include N-trimethoxy silylpropyl N,N,N-trimethylammonium chloride (TMAPS), 3-methacryloxypropyl(trimethoxy)silane (MAPS), or glycidylpropoxysilane (GPS). TMAPS, MAPS, and GPS are exemplary only, as all three of these active ligands include a propyl or 3 carbon silane-containing spacer group. As the spacer group length is not critical, other spacer groups can alternatively be used, such as spacer groups having from 1 to 10 carbon atoms, and as otherwise described herein. By varying the active ligand, varying whether or not a silane spacer group is present (and at what length), and how active ligand is attached, tailoring of the surface isoelectric point and control of dye absorption can be effectuated.

The pH range from 3 to 4 is preferred for the reaction, though slower reactions that are functional can occur at pH ranges from 2 to 3 and 4 to 4.5. The ratio of carboxylic acid to boehmite and the reaction pH can control the extent of the reaction where a low carboxylic acid concentration, e.g., 0.5 to 1 wt % of active ligand molecule based on the quantity of boehmite solid, appears to result in surface modification of the boehmite with low percent soluble fraction being produced (alumoxane). Higher ratios, such as up to 50 wt % glycine or betaine based on the quantity of boehmite solids, can provide an increased percent yield of a soluble fraction, and the apparent conversion of the solid boehmite to a soluble, small molecule alumoxane structure.

Formulation of paper coatings using the surface-modified alumina can be identical to standard alumina coatings for ink reception, with the exception that the alumina material is first chemically modified (or modified by adsorption). For example, a quaternary amine additive can be attached to the alumina at a much lower concentration that when it is merely admixed. Further, though a smaller amount is used, equivalent or superior water and wet smudge resistance can be realized. Dispersion stabilization of the colloidal alumina particles by the strongly basic groups, such as those obtained by quaternary ammonium betaine surface modification, may allow for higher percent alumina coating formulations at similar viscosity to previously unmodified alumina coating formulations for more cost-efficient coating applications.

The following provides examples of modification schemes wherein carboxylic acid containing active ligands can be attached to a boehmite surface.

Formula 1

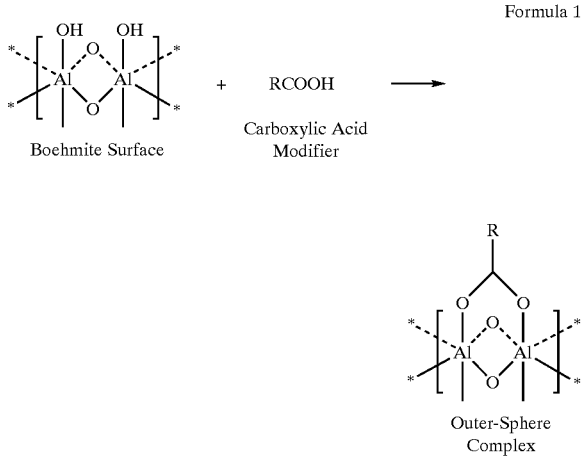

In the above formula, R can be any organic grouping having attached thereto a carboxylic acid (—COOH) functionality. Examples of such RCOOH combinations can include aliphatic acids, hydroxy acids, amino acids, or quaternary amine acids.

The following provides examples of modification schemes wherein an organosilane modifier is used to attach an active ligand to a boehmite surface. For example, 3-amino-propyl-triethoxysilane [—$H_2NCH_2CH_2CH_2Si(OCH_2CH_3)$ 3], chloro-N,N,N-trimethyl ammonium-propyl-trimethoxysilane [—$Cl^-(CH_3)_3N^+CH_2CH_2CH_2Si(OCH_3)$ 3], and 3-glycidoxy-propyl-trimethoxysilane [3-glycidoxy-$CH_2CH_2Si(OCH_3)$ 3]. With these examples, the silane group(s) can be attached to the alumina surface by direct reaction to the surface (Formula 2), by a silane condensation surface reaction (Formula 3 and Formula 4), and/or by a particle bridging reaction (Formula 5), as shown schematically below.

Formula 2

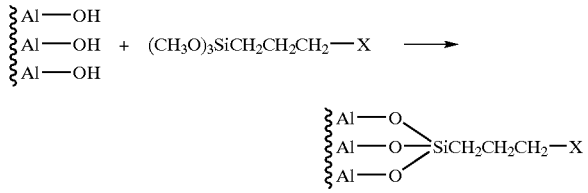

Formula 3

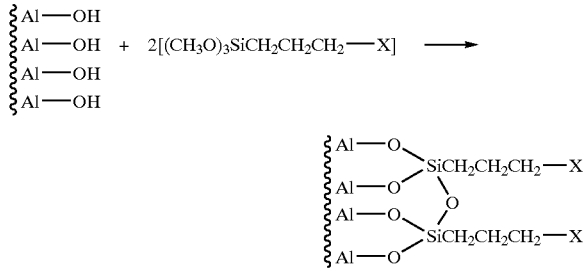

Formula 4

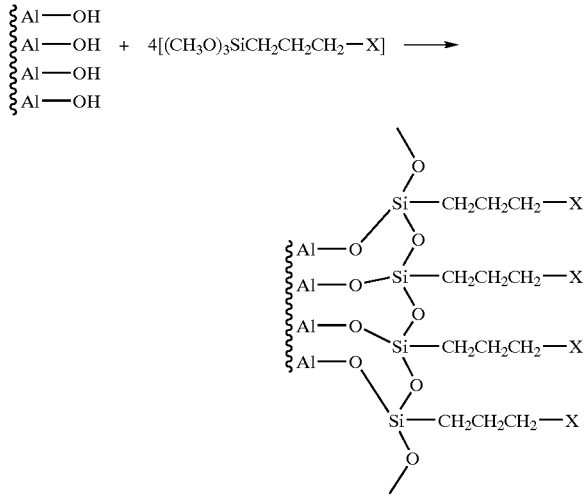

Formula 5

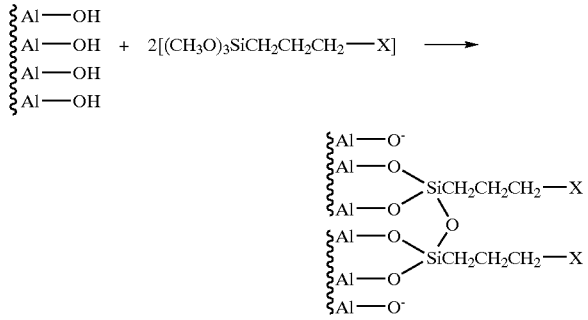

In the above Formulas, X can be an active ligand, or any group that is reactive with an active ligand. For example, if X is a reactive group, X can be −3-amino-, chloro-N,N,N-trimethyl ammonium, or 3-glycidoxy-. If X is an active ligand, X can be an aliphatic acid, a hydroxy acid, an amino acid, or a quaternary amine acid. In the embodiments shown in Examples 2 to 5, propyl groups are present that can act as the optional spacer group. However, other spacer groups can be present, such as spacer groups having from 1 to 10 carbons in length, either branched or straight chain where appropriate. Other spacer groups can include —$(CH_2)_b$NH(C)O—, —$(CH_2)_aO(CH_2)_b$—, or —$(CH_2)_b$NH—, where a is from 0 to 3 carbons, and b is from 1 to 10 carbons. A spacer group can act to provide distance and flexibility between the alumina particulate and the active ligand.

With respect to either embodiment where a carboxylic group is used to make the modification, or where an organosilane group is used for the modification, the active ligands that can be used are typically the same. In both embodiment, aliphatic acids, hydroxy acids, amino acids, and quaternary amine acids can be used to name a few. Examples of aliphatic acids include propionic acid, lactic acid, and acetic acid. Examples of hydroxy acids include hydroxy acetic acid and hydroxy butyric acid. Examples of amino acids include glycine, a-alanine, and lysine. An example of a quaternary amine acid includes betaine.

There are several advantages that can be realized when using the coatings of the present invention with ink-jet inks. For example, if an amine group is used as the active ligand (as amines are typically cationic at low pH), coatings can be attractive to anionic dyes. Though alumina has some attraction for anionic dyes, the attraction can be made stronger using active ligands having a cationic charge. Further, various active ligands can provide the advantage of stabilization through, for example, deactivation of ozone.

In addition to these advantages, because alumina is an inorganic substance, the presence of van der Waals interactions are generally not provided in coating compositions by the alumina itself. However, by attaching an organic active ligand to the surface, better van der Waals interaction can be realized. Further, by attaching an active ligand that protrudes form the surface of the alumina, a greater orientation freedom of a cationic moiety can be realized. This is especially true when a spacer group is present.

EXAMPLES

The following examples illustrate various aspects of coatings for porous ink-jet ink media substrates. The following examples should not be considered as limitations of the invention, but should merely teach how to make the best coatings, reflecting the present invention.

Example 1

Preparation of Glycine- and Betaine-modified Boehmite

About 50 g of boehmite (Dispal 9N6-80) was modified with 0.5 wt % quaternary glycine (proteinated to make a quaternary amine using a low pH system) and 0.5 wt % betaine at pH 3.5 to 4.0 (adjusted with dilute $HNO_3$) in boiling water for 48 hours. The insoluble portion was centrifuged off and washed twice with deionized water. No free glycine was detected in the supernatant of the second wash with ninhydrin reagent through the modified boehmite gave ninhydrin color change, a 5% weight loss on thermogravimetric analysis (TGA), showed infrared absorption bands at 1635 and 1407 $cm^{-1}$ indicating the presence of a bound carboxyl but also boehmite absorption bands at 3450 $cm^{-1}$.

Example 2

Preparation of Glycine Modified Boehmite

About 3.6 g of boehmite (Catapal 200) and 3.0 g of glycine was added to 40 ml of deionized water. The composition was magnetically stirred, heated to 90° C., and kept under these conditions for about 48 hours. The system showed low viscosity during the entire process. After finishing the reaction and allowing the product to cool, 20.0 g of product suspension was filtered through a 500NMWL filter membrane, and the insoluble solids above the filter paper were thoroughly washed with deionized water. The insoluble solid and soluble material in the filtrate was dried in an oven. About 1.55 g of insoluble solid and 1.37 g of soluble material were obtained.

Example 3

Preparation of Betaine Modified Boehmite

About 3.6 g of boehmite (Catapal B) and 3.51 g of betaine was added into 40 ml of deionized water with mechanical stirring and reflux for 68.5 hours. The system showed high viscosity at high temperature, but low viscosity at room temperature. After finishing the reaction and cooling down, 20.0 g of product suspension was filtered through 5000 NMWL filter membrane, and the insoluble solids above the filter paper was washed thoroughly with deionized water. The insoluble solid and soluble material in the filtrate was dried in an oven. An insoluble solid (1.26 g) and 1.52 g of soluble material was obtained.

Example 4

Preparation of Lactic Acid Modified Boehmite

About 3.6 g (60 mmol) boehmite (Catapal B) and 4.24 g of (40 mmol) lactic acid (85%) were added into 40 ml of deionized water. With a magnetic stirring, the suspension was refluxed for 24 hours. During the reaction, the pH decreased from 2.08 (room temperature, before reaction) to 3.50 (room temperature, after reaction). As the pH changed, the dispersibility of the boehmite was observed to improve. About 20 g of product suspension was filtered through a 5000NMWL filter membrane, and the insoluble solids above the filter paper were washed away with deionized water. The remaining insoluble solid and soluble material were dried in an oven. About 0.92 g of the insoluble solid and 1.48 g soluble material were obtained upon evaporation of the filtrate. The resulting product was a very dry solid product, i.e., no evidence of liquid lactic acid. The boehmite to acid was 1:0.84 by weight.

Example 5

Preparation of Hydroxyacetic Acid Modified Boehmite

About 3.6 g (60 mmol) of boehmite (Catapal B) and 4.34 g (40 mmol) of hydroxyacetic acid (70%) were added into 50 ml of deionized water. The suspension was mechanically stirred and heated to from 85 to 90° C. for 72 hours. During the reaction, the pH decreased from 2.14 (room temperature, before reaction) to 3.22 (room temperature, after reaction), and the dispersibility of boehmite was improved. About 20 g of product suspension (total percent solids=6.88%) was filtered through a 500NMWL filter membrane, and the insoluble solids above the filter paper were washed away with deionized water. The remaining insoluble solid and soluble material in filtrate was dried in an oven. About 0.6 g of insoluble solid and 0.75 g of soluble material from the soluble portion after evaporation were obtained. The solid material isolated from the filtrate upon evaporation was very dry and not sticky. The mass ratio of boehmite to acid was 1:0.74.

Example 6

Preparation of Propionic Acid Modified Boehmite

About 25 g (417 mmol) of boehmite (Catapal B) and 2.50 g (33.8 mmol) of propionic acid were added into 72.5 g of deionized water. With mechanical stirring, the suspension was heated to from 85 to 90° C. (as the system is very viscous when refluxing, more Dl water was added and a lower reaction temperature was set compared to other examples) for 48 hours. During the reaction, an initial pH of ~4.2 did not significantly change. However, the dispersibility of boehmite was improved over the course of the reaction. The reaction product was viscous and opaque. About 10.0 g of product suspension was filtered through a 5000NMWL filter membrane, and the insoluble solids above the filter paper were washed away with deionized water. The insoluble solid and soluble material in filtrate was dried in an oven. About 1.7 g of insoluble solid and a very small amount of soluble material were obtained.

Example 7

Preparation of Lysine Modified Boehmite

About 3.6 g of boehmite (Dispal 99N-80) and 7.12 g of lysine.HCl was added into 60 ml of deionized water, and the pH of suspension system was adjusted to 4.0 with nitric acid. While under magnetic stirring, the reaction was heated to 90° C. and temperature maintained for 72 hours. The suspension system became more viscous with the increasing temperature, but the viscosity reduced after 24 hours reaction time. After cooling down, about 20 g of product suspension was filtered through a 5000NMWL filter membrane, and the insoluble solids above the filter paper were washed from the filter paper with deionized water. The insoluble solid and soluble material in filtrate was dried in an oven. About 0.92 g insoluble solid and 1.91 g soluble material were obtained. In raw material, the mass ratio of boehmite to lysine.HCl was 1:1.98.

Example 8

Preparation of TMAPS-modified Boehmite

Six boehmite samples were dispersed into and reacted with chloro-trimethylammonium propyl (trimethoxy)silane (TMAPS; N-Trimethoxy silylpropyl-N,N,N-trimethylammonium chloride), and dissolved in refluxing methylisobutylketone (MIBK). The reaction extent was determined by isolating the product using filtration or centrifugation and, after baking the product for 1 hour at 110° C. in a conventional oven, analyzed neat (unwashed) or washed with water prior to analysis. Thermogravimetric weight loss directly measures the weight of the combustible portion (carbon-, nitrogenaceous part) of the bound fraction. Separately, thermogravimetric analysis (TGA) weight loss was correlated to an actual functional group loss using infrared absorption spectroscopy, i.e., loss of IR absorbance bands assigned to TMAPS, of the TGA samples at different temperatures during the analyses. Less weight loss occurred for lower percent TMAPS to boehmite ratios and for water washed samples due to less bound fraction being present for these samples. A water washing step was used to remove excess TMAPS reagent. The weight loss measured by TGA increased through 10% TMAPS to boehmite ratio; however, after washing the weight loss became constant for all samples at 8% or higher TMAPS to boehmite. Constant weight loss indicated that approximate ratio 8% w/w TMAPS to boehmite is a stoichiometric ratio of molecules of TMAPS to the available boehmite surface sites.

The extent of surface modification, or organosilane layer thickness, may be varied over the range 0 to 8% by weight for TMAPS, or at a ratio appropriate for the stoichiometric weight of another silane agent. Thus, the amount of surface reactive groups added to the boehmite can be controlled until all surface (e.g., ≅Al—OH) boehmite sites are occupied by the chloro-trimethylammonium propyl (trimethoxy) silane. See Table 1 below

TABLE 1

TGA weight loss at from 150° C. to 730° C. of TMAPS modified boehmite

| TMAPS added: boehmite | TGA weight loss (150° C. to 730° C.) | |
|---|---|---|
| (wt %) | Unwashed | Water-washed |
| 0.0 | 15.51% | 15.51% |
| 2.0 | 16.63% | 16.11% |
| 4.0 | 17.56% | 16.65% |
| 6.0 | 18.31% | 17.53% |
| 8.0 | 19.10% | 18.18% |
| 10.0 | 19.91% | 18.21% |

Example 9

TMAPS-modified Boehmite Under XPS

Water washed TMAPS-modified boehmite samples were subjected to x-ray photoelectron spectroscopy (XPS), which measures a surface-specific elemental composition of the boehmite samples. XPS showed that percentages of carbon, nitrogen, and chlorine at the surface increased through 8% w/w TMAPS ratio to boehmite, but that aluminum and oxygen content decreased over the sample range. See Table 2 below.

TABLE 2

XPS Surface Atomic Percents for TMAPS Modified Boehmite

| TMAPS reaction ratio to boehmite | | XPS atomic concentration (mol %) | | | | | | Molar ratio to aluminum | | | |
|---|---|---|---|---|---|---|---|---|---|---|---|
| wt. % | mol. % | $Al_{2p}$ | $Si_{2p}$ | $C_{1s}$ | $N_{1s}$ | $O_{1s}$ | $Cl_{2p}$ | Si | C | N | Cl |
| 0.00 | 0.00 | 27.78 | 0.35 | 5.05 | 0.10 | 66.56 | 0.15 | 1.3% | 18% | 0.4% | 0.5% |
| 2.00 | 0.47 | 26.42 | 0.81 | 8.20 | 0.51 | 63.97 | 0.08 | 3.1% | 31% | 1.9% | 0.3% |
| 4.00 | 0.93 | 26.12 | 0.89 | 8.29 | 0.58 | 63.90 | 0.23 | 3.4% | 32% | 2.2% | 0.9% |
| 6.00 | 1.40 | 26.38 | 0.92 | 8.63 | 0.86 | 62.65 | 0.55 | 3.5% | 33% | 3.3% | 2.1% |
| 8.00 | 1.86 | 25.91 | 1.03 | 8.75 | 1.23 | 62.36 | 0.73 | 4.0% | 34% | 4.7% | 2.8% |

Example 10

Preparation of TMAPS-modified Boehmite Using Various Solvents

Surface modification of boehmite with TMAPS was carried out by dispersing 10 g of boehmite with 1 g of TMAPS in a 40 ml solvent (acetone, MEK or MIBK), and then refluxed for 2 hours. The sample was rotary evaporated, heated to dryness in a conventional oven to heat-fix the silane at 105° C. for 0.5~1 hr. The dried samples were washed with water twice and redispersed followed by 5000 NMWL ultrafiltration, or alternatively, washed with ethanol twice and redispersed followed by decantation. The washed samples were dried in a conventional oven, and the organic compositions were analyzed with TGA weight loss. See Table 3 below.

TABLE 3

TGA weight loss over the 150° C. to 730° C. temperature range of TMAPS-modified boehmite

| Solvent | | TGA weight loss over 150° C. to 730° C. range | | |
|---|---|---|---|---|
| Type | b.p. (° C.) | Unwashed | Water washed | Ethanol washed |
| Acetone | 56 | 19.49 | 16.79 | 16.57 |
| MEK | 80 | 19.73 | 16.23 | 16.67 |
| MIBK | 115~116 | 19.58 | 17.69 | 17.86 |
| *MIBK | 115~116 | 19.91 | 18.21 | 18.16 |

*The reaction time was 12 hours, instead of 2 hours.

Table 3 above shows TGA weight loss over the 150° C. to 730° C. temperature range for the TMAPS-modified boehmites as prepared in different solvents. The results indicate that the modified boehmite mode in higher boiling point solvent showed better solvent (water or ethanol) stability. Longer reaction time also improved the solvent stability. Additionally, the extent of modification was found to be a function of the solvent boiling point, or the temperature applied during the surface modification reflux step, and the length of reaction time. Solvents of increasing boiling point and longer reaction times at constant solvent type gave increased surface modification as measured by the TGA weight loss method.

Example 11

Aqueous Stability of Surface-bound Layer of TMAPS-modified Boehmite

An 8% w/w TMAPS-modified boehmite sample was checked for water sensitivity of the surface modification to water or ethanol soaking. Boiling water was found to remove much of the surface modification. For comparison purposes, unmodified boehmite has a room temperature (R.T.) water value of 15.5, and a Boiling water value of 15.5. See Table 4 below.

TABLE 4

TGA weight loss of 8% TMAPS-modified boehmite as a function of product soak time and temperature

| Soak time (hr) | R.T. water | Boiling water |
|---|---|---|
| 0 | 18.18 | 18.18 |
| 2 | 18.16 | 17.32 |
| 4 | 17.89 | 17.06 |
| 8 | 17.98 | 16.97 |

TABLE 4-continued

TGA weight loss of 8% TMAPS-modified boehmite as a function of product soak time and temperature

| Soak time (hr) | R.T. water | Boiling water |
|---|---|---|
| 20 | 17.93 | 16.74 |
| 30 | 17.52 | 16.7 |
| 50 | 17.71 | 16.79 |

Table 4 above provides data for modification of boehmite using TMAPS in refluxing MIBK solvent and retention of surface modification as a function of post-reaction water soak time.

Other silanes, such as acrylic or methacrylic (alkene), alkyne, epoxy (glycidyl), aromatic alcohols, thiol, carboxylate, sulfonate, phosphonate, phosphate or phosphate ester, can be used to provide benefit to a print water resistance or facilitate reductions in added coating binder depending on the composition of the printing ink system to be applied or the type of added resin binder and its mechanism of crosslinking or association film formation.

Example 12

Preparation of MAPS-modified Boehmite

Surface modification of boehmite (Dispal 14N4-80) with 3-methacryloxypropyl (trimethoxy)silane (MAPS) was made by dispersing 10 g of boehmite with 1 g of MAPS in solvent, stirring at room temperature for 1 day. The sample was rotary evaporated, heated to dryness in a conventional oven to fix the silane at 110° C. for 0.5~1 hr, washed with ethanol twice, and again dried in the oven. Solvents with various compositions of ethanol and water were tried in order to study the solvent effect. No significant solvent effect was observed. MAPS was soluble in greater than 40% aqueous ethanol. A decreased surface-bound amount was found for aqueous reactions of TMAPS, 3-amino-propyl (triethoxy)silane, and other polar group silanes with boehmite. For comparison purposes, TGA weight loss for unmodified boehmite was 15.51% See Table 5 below.

TABLE 5

Surface modification of boehmite with MAPS as a function of reaction solvent type

| Reaction solvent | TGA weight loss over 150 to 730° C. range |
|---|---|
| Ethanol | 17.75% |
| Ethanol:water = 60:40 | 17.52% |
| Ethanol:water = 40:60 | 17.66% |
| Water | 17.38% |

Example 13

Preparation of Glycidylpropoxysilane (GPS) Modified Boehmite

Surface modification of boehmite (Dispal 14N4-80) was carried out by dispersing the boehmite into ethanol, and then adding GPS dropwise. The system was stirred for about 10 min. at room temperature, centrifuged and dried in vacuum oven over night (<60° C.). The sample was then heated at 110° C. to fix the silane coupling agent onto the surface of boehmite. The resulting dry powder was washed with 10 times ethanol twice and again dried in 110° C. oven. The weight loss between 150° C. and 730° C. was measured with TGA, before washing and after washing (Table 1). Comparing the weight loss of GPS modified boehmite before washing and after washing with ethanol, washed samples had less organic content than unwashed samples due to removal of free and oligomeric GPS. Thus, surface modification of boehmite with GPS can be carried out in ethanol followed by washing with ethanol. Surface coverage appears complete at near 8% w/w GPS to boehmite. See Table 6 below.

TABLE 6

TGA Weight Loss of GPS Modified Dispal 14N4-80 Over the 150~730° C. temperature range

| Dispal14N4-80 | GPS added (wt %) | TGA weight loss (%) Before washing | TGA weight loss (%) After washing | Delta weight loss (%) |
|---|---|---|---|---|
| Neat | 0.0 | 15.83 | 15.51 | −0.32 |
| GPS-A | 5.4 | 18.01 | 17.12 | −0.89 |
| GPS-B | 8.0 | 18.40 | 18.09 | −0.31 |
| GPS-C | 12.0 | 19.16 | 18.79 | −0.37 |
| GPS-D | 16.1 | 19.87 | 19.15 | −0.72 |

Example 14

Preparation of Glycine- and Betaine-modified Boehmite

A glycine- and betaine-modified boehmite sample was prepared as in Example 1 (0.5%/0.5% glycine/betaine by weight). Additionally, a similar composition to that described in Example 1 was prepared, except that the active ligand was only glycine (1% glycine by weight). The coating pigments were dispersed in water and mixed with 12 wt % of Airvol 523 (polyvinyl alcohol) such that the total solids was about 14 wt %. The solution was used to coat a resin-coated paper and then dried. The samples were then printed with a DeskJet 970C printer and subjected to a water drip test, a color bleed test at high humidity, a gas fade test with a fan blowing on the print, and a light fade test at 60 klux using cool-white fluorescent bulbs. The results relative to the unmodified boehmite are as follows in Tables 7–10:

TABLE 7

Waterfastness (OD)

| Sample | k | c | m | y |
|---|---|---|---|---|
| 0.5%/0.5% glycine/betaine | 0.33 | 0.08 | 0.08 | 0.18 |
| 1% glycine | 0.07 | 0.11 | 0.15 | 0.08 |
| unmodified | 0.16 | 0.05 | 0.10 | 0.06 |

TABLE 8

Humidfastness (:m)

| Sample | k halo | m halo | max color-color |
|---|---|---|---|
| 0.5%/0.5% glycine/betaine | 168 | 102 | 411 |
| 1% glycine | 389 | 142 | 640 |
| unmodified | 361 | 112 | 577 |

TABLE 9

Gas Fade (% loss)

| Sample | c | m | y |
|---|---|---|---|
| 0.5%/0.5% glycine/betaine | 0.14 | 0.26 | 0.15 |
| 1% glycine | 0.13 | 0.22 | 0.09 |
| unmodified | 0.08 | 0.24 | 0.20 |

TABLE 10

Light Fade (% loss)

| Sample | c | m | y |
|---|---|---|---|
| 0.5%/0.5% glycine/betaine | 0.24 | 0.13 | 0.11 |
| 1% glycine | 0.23 | 0.13 | 0.06 |
| unmodified | 0.25 | 0.14 | 0.18 |

The glycine modified boehmite showed improved black waterfastness, improved yellow gas fade, and improved light fade across the board. The glycine- and betaine-modified boehmite showed improved magenta waterfastness, humidfastness across the board, improved yellow gas fade, and improved light fade across the board relative to the unmodified sample.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A coated media substrate for ink-jet ink printing, comprising:

(a) a media substrate, having coated thereon, (b) a porous coating, said porous coating comprising an aluminum oxide particulate having surface hydroxyls being modified by an attached organic active ligand.

2. A coated media substrate as in claim 1, wherein the aluminum oxide having surface hydroxyls is boehmite.

3. A coated media substrate as in claim 1, wherein organic active ligand is configured to interact with an anionic dye molecule.

4. A coated media substrate as in claim 1, wherein the aluminum oxide is modified by the active ligand through a covalent attachment.

5. A coated media substrate as in claim 1, wherein the aluminum oxide is modified by the active ligand through adsorption.

6. A coated media substrate as in claim 1, wherein the substrate is selected from the group consisting of films, papers, and photographic media.

7. A coated media substrate as in claim 1, wherein the active ligand is an aliphatic acid having from 1 to 10 carbons.

8. A coated media substrate as in claim 1, wherein the active ligand is an alcohol.

9. A coated media substrate as in claim 1, wherein the active ligand is a hydroxy acid.

10. A coated media substrate as in claim 1, wherein the active ligand is an amino acid.

11. A coated media substrate as in claim 1, wherein the active ligand is a quaternary amine acid.

12. A coated media substrate as in claim 1, wherein the organic active ligand comprises a silane spacer group, and the silane spacer group is covalently attached to the aluminum oxide particulate.

13. A coated media substrate as in claim 12, wherein the organic active having the silane spacer group is selected from the group consisting of N-trimethoxy silylpropyl N,N, N-trimethylammonium chloride (TMAPS), 3-methacryloxypropyl(trimethoxy)silane (MAPS), or glycidylpropoxysilane (GPS).

14. A coated media substrate as in claim 1, wherein the organic active ligand comprises a carboxylic acid group, and wherein the organic active ligand is attached to the aluminum oxide particulate through a reactive product of a carboxylic acid group and at least one of the surface hydroxyls.

15. A system for producing permanent ink-jet ink images, comprising:

(a) a substrate, having coated thereon a porous coating, said porous coating comprising active ligand-modified alumina particulates; and (b) an ink-jet ink comprising a composition configured for interacting with the active ligand portion of the active ligand-modified alumina particulates upon printing the ink-jet ink onto the porous coating.

16. A system as in claim 15, wherein the ink-jet ink physically interacts with the alumina particulates portion of the active ligand-modified alumina particulates.

17. A system as in claim 15, wherein the composition is a dye.

18. A system as in claim 17, wherein the dye is oppositely charged with respect to the active ligand.

19. A system as in claim 15, wherein the alumina particulates of the active ligand-modified alumina particulates are boehmite.

20. A system as in claim 15, wherein the ajumina particulates are modified by the active ligand through covalent attachment.

21. A system as in claim 15, wherein the alumina particulates are modified by the active ligand through adsorption.

22. A system as in claim 15, wherein the substrate is selected from the group consisting of films, papers, and photographic media.

23. A system as in claim 15, wherein the active ligand is selected from the group consisting of aliphatic acids having from 1 to 10 carbons, hydroxy acids, alcohols, amino acids, and quaternary amine acids.

24. A system as in claim 15, wherein the active ligand-modified alumina particulates comprise an organic active ligand attached to aluminum oxide particulates having surface hydroxyls, said organic active ligand having a silane spacer group, said active ligand being attached to the aluminum oxide particulates through the silane spacer group.

25. A system as in claim 24, wherein the organic active ligand having the silane spacer group is selected from the group consisting of N-trimethoxy silyipropyl N,N,N-trimethylammonium chloride (TMAPS), 3-methacryloxypropyl(trimethoxy)silane (MAPS), or glycidylpropoxysilane (GPS).

26. A system as in claim 15, wherein the active ligand-modified alumina particulates comprise an organic active ligand attached to aluminum oxide particulates having surface hydroxyls, wherein the organic active ligand comprises a carboxylic acid group, and wherein the organic active ligand is attached to the aluminum oxide particulate through a reactive product of a carboxylic acid group and at least one of the surface hydroxyls.

* * * * *